US007874164B2

(12) United States Patent
Gandza

(10) Patent No.: US 7,874,164 B2
(45) Date of Patent: Jan. 25, 2011

(54) FUEL NOZZLE FLANGE WITH REDUCED HEAT TRANSFER

(75) Inventor: Victor Gandza, Bolton (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 1118 days.

(21) Appl. No.: 11/556,229

(22) Filed: Nov. 3, 2006

(65) Prior Publication Data

US 2008/0105237 A1 May 8, 2008

(51) Int. Cl.
*F02C 7/20* (2006.01)

(52) U.S. Cl. ..... 60/796; 60/798

(58) Field of Classification Search ..... 60/796, 60/798, 799, 800, 740; 277/647; 239/273, 239/282, 397.5
See application file for complete search history.

(56) References Cited

U.S. PATENT DOCUMENTS

| | | | | |
|---|---|---|---|---|
| 5,771,696 | A * | 6/1998 | Hansel et al. | 60/739 |
| 6,463,739 | B1 * | 10/2002 | Mueller et al. | 60/765 |
| 7,114,321 | B2 * | 10/2006 | Belsom et al. | 60/39.091 |
| 7,249,461 | B2 * | 7/2007 | Moraes | 60/796 |
| 7,540,157 | B2 * | 6/2009 | Fish | 60/798 |
| 2005/0000226 | A1 * | 1/2005 | McCaffrey et al. | 60/796 |

* cited by examiner

*Primary Examiner*—Michael Cuff
*Assistant Examiner*—Vikansha S Dwivedi
(74) *Attorney, Agent, or Firm*—Ogilvy Renault LLP

(57) ABSTRACT

A fuel nozzle for a gas turbine engine comprises a nozzle body defining a passage extending therethrough and a flange around the nozzle body extending radially and outwardly from the nozzle body. The flange defines a mounting face thereof and a plurality of mounting holes in the mounting face extending through the flange. The mounting face includes a contacting land protruding from the mounting face for abutting a mounting surface of a support structure of the engine when the fuel nozzle is mounted to the support structure.

5 Claims, 6 Drawing Sheets

FUEL NOZZLE FLANGE WITH REDUCED HEAT TRANSFER

TECHNICAL FIELD

The invention relates generally to gas turbine engines, and more particularly, to an improved fuel nozzle installation structure in gas turbine engines.

BACKGROUND OF THE ART

Gas turbine engines must be run at very high temperatures, particularly in a combustor section thereof where engine fuel is burned in combustion with high pressure air to form high temperature, high pressure combustion gases. These gases are used downstream of the combustor by a turbine section where the kinetic energy of the gases powers the engine. Therefore, it is desirable to increase the temperature of the combustion gases for more effective engine performance. However, the durability of an engine fuel system, particularly of fuel nozzles, is challenged in such an elevated temperature environment. The fuel nozzles are typically mounted to a hot engine case from which heat is transferred to the fuel nozzles. Therefore, fuel leakages and internal nozzle blockages caused by the heat transferred to the nozzles are always issues of concern for engine designers.

Accordingly, there is a need to provide an improved fuel nozzle structure and/or fuel nozzle installation structure in gas turbine engines, in order to prevent fuel leakages and internal nozzle blockage caused by the heat from such an elevated temperature environment.

SUMMARY OF THE INVENTION

It is therefore an object to provide an improved fuel nozzle structure for fuel nozzle installation in gas turbine engines.

In one aspect, there is provided a fuel nozzle for a gas turbine engine, which comprises a nozzle body defining a passage extending therethrough and a flange around the nozzle body extending radially and outwardly from the nozzle body, the flange defining a mounting face thereof and a plurality of mounting holes in the mounting face extending through the flange, the mounting face including a plurality of contacting lands spaced apart one from another and protruding from the mounting face for securely abutting a flat mounting surface of a support structure of the engine when the fuel nozzle is installed in the engine.

In another aspect, there is provided a fuel nozzle installation structure in a gas turbine engine, which comprises a support structure including a flat mounting surface and defining an aperture in the flat mounting surface, the aperture extending through the support structure; a fuel nozzle including a nozzle body defining a passage therethrough for directing a fuel flow through the fuel nozzle and a flange around the nozzle body extending radially and outwardly from the nozzle body, the nozzle body being inserted into the aperture of the support structure and the flange of the fuel nozzle being mounted to the mounting surface of the support structure; and means for spacing between the flange and the mounting surface to reduce heat transfer from the support structure to the fuel nozzle during engine operation.

In a further aspect, there is provided a method for reducing heat transfer from a hot gas turbine engine case to a fuel nozzle mounted to the case through a flange of the fuel nozzle, which comprises disposing at least one spacing element between the flange and the case to thereby reduce a contacting area between the flange and the case.

Further details of these and other aspects will be apparent from the detailed description and drawings included below.

DESCRIPTION OF THE DRAWINGS

Reference is now made to the accompanying drawings, in which.

DETAILED DESCRIPTION OF THE PREFERRED EMBODIMENTS

Figure 1:
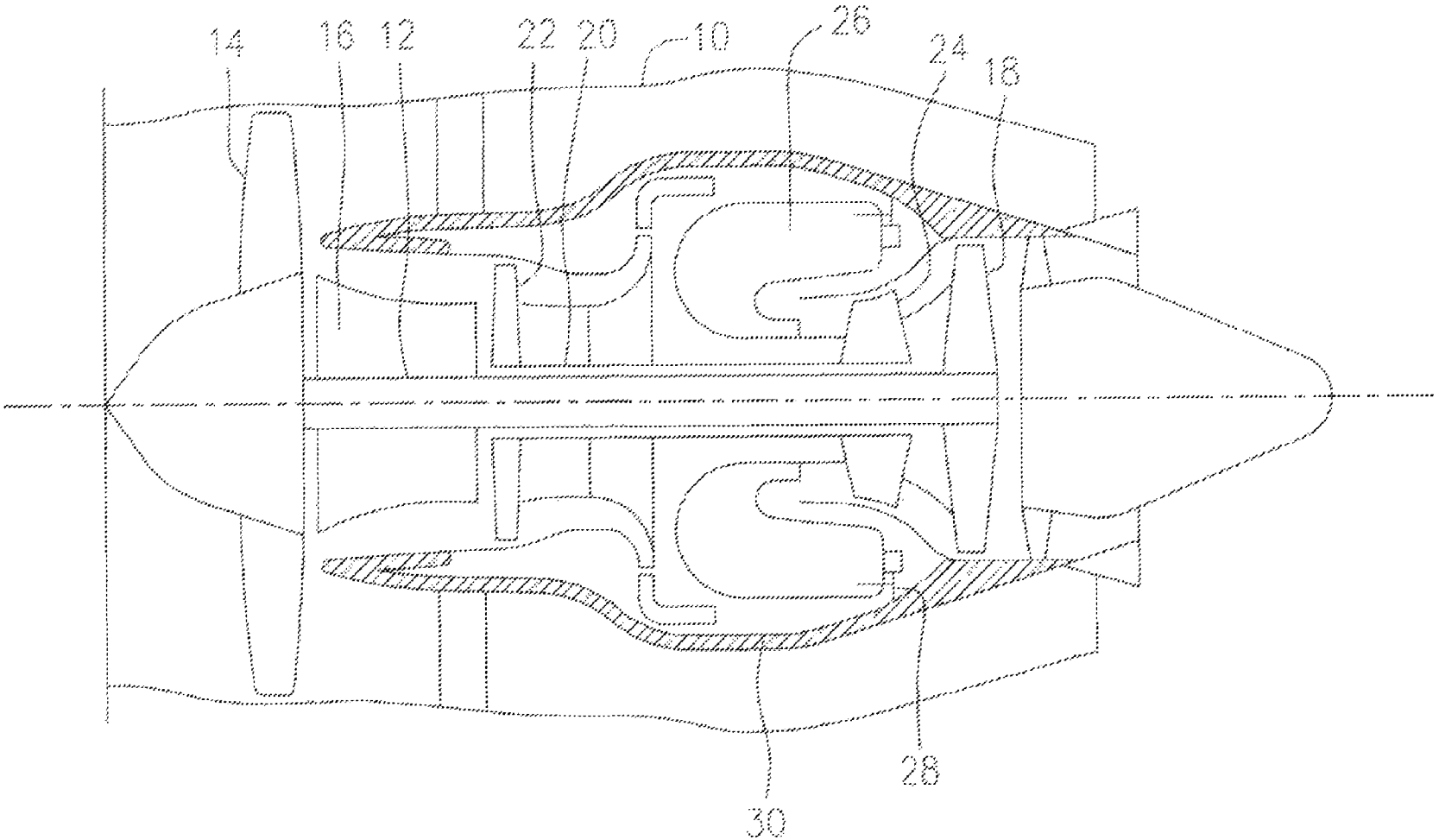
FIG. 1 is a schematic cross-sectional view of an exemplary turbofan gas turbine engine.

A typical application of the present invention for a turbofan engine is illustrated schematically in FIG. 1, and incorporates an embodiment of the present invention, which is presented as an example. The turbofan engine includes a housing or nacelle 10, a low pressure spool assembly seen generally at 12 which includes a fan 14, a low pressure compressor 16 and low pressure turbine 18, a high pressure spool assembly seen generally at 20 which includes a high pressure compressor 22 and a high pressure turbine 24. There is provided an annular combustor 26 where hot combustion gases are produced to power the turbines 24 and 18. An engine fuel system 28 is provided for distributing fuel to the combustor 26 to be ignited for combustion.

Figure 2:
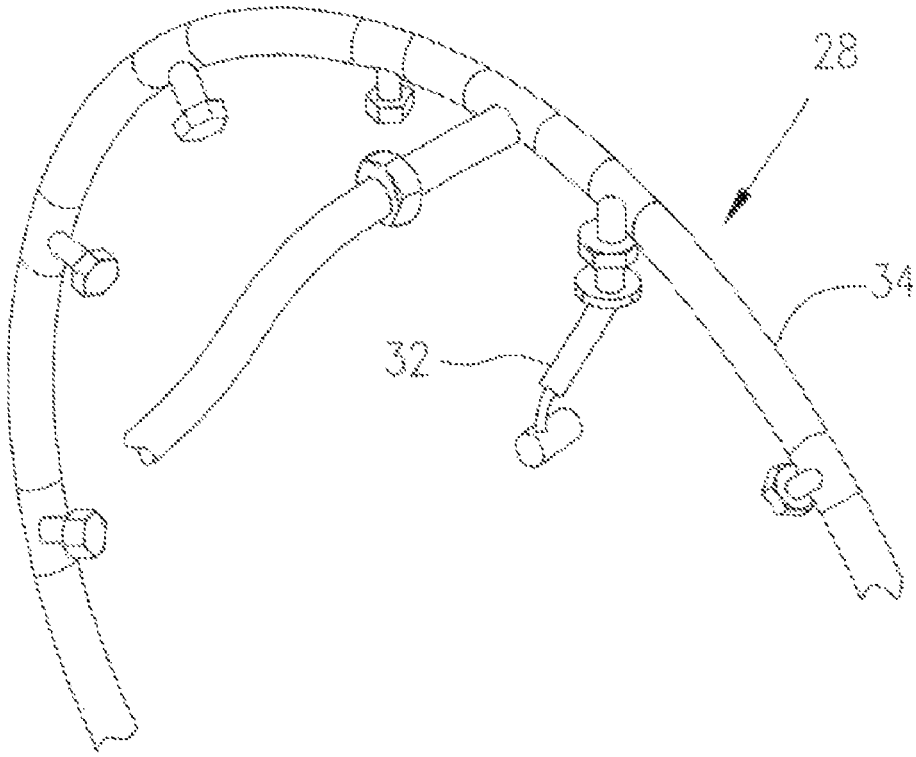
FIG. 2 is a perspective partial view of a fuel system of the gas turbine engine of FIG. 1.

Referring to FIGS. 1 and 2, the annular combustor 26 is disposed between the high pressure compressor 22 and the high pressure turbine 24 and is supported within a core casing 30 of the turbofan engine. The fuel system 28 includes a plurality of fuel nozzles 32 connected by a fuel manifold assembly 34 which in turn is connected to a fuel source (not shown) of the engine. The plurality of fuel injectors 32 are disposed along the fuel manifold assembly 34, circumferentially spaced apart one from another and are mounted within the core casing 30. Each of the fuel nozzles 32 inject fuel mixed with air into the annular combustor 26 for combustion.

One of the problems inherent in the operation of a gas turbine engine is the affect of high temperatures that are developed in the region of combustion. These high temperatures put a tremendous thermal strain on engine components. Even more importantly, safety hazards caused by high temperatures must be fully considered by the engine designers. Fuel leakage considerations become important in the area surrounding the combustor 26. Internal nozzle blockage of hot fuel passing through the nozzles must also be considered. Therefore, the present concept is directed to an installation structure of fuel nozzles to reduce heat transfer from the high temperature environment to the fuel nozzles 32.

Figure 3:
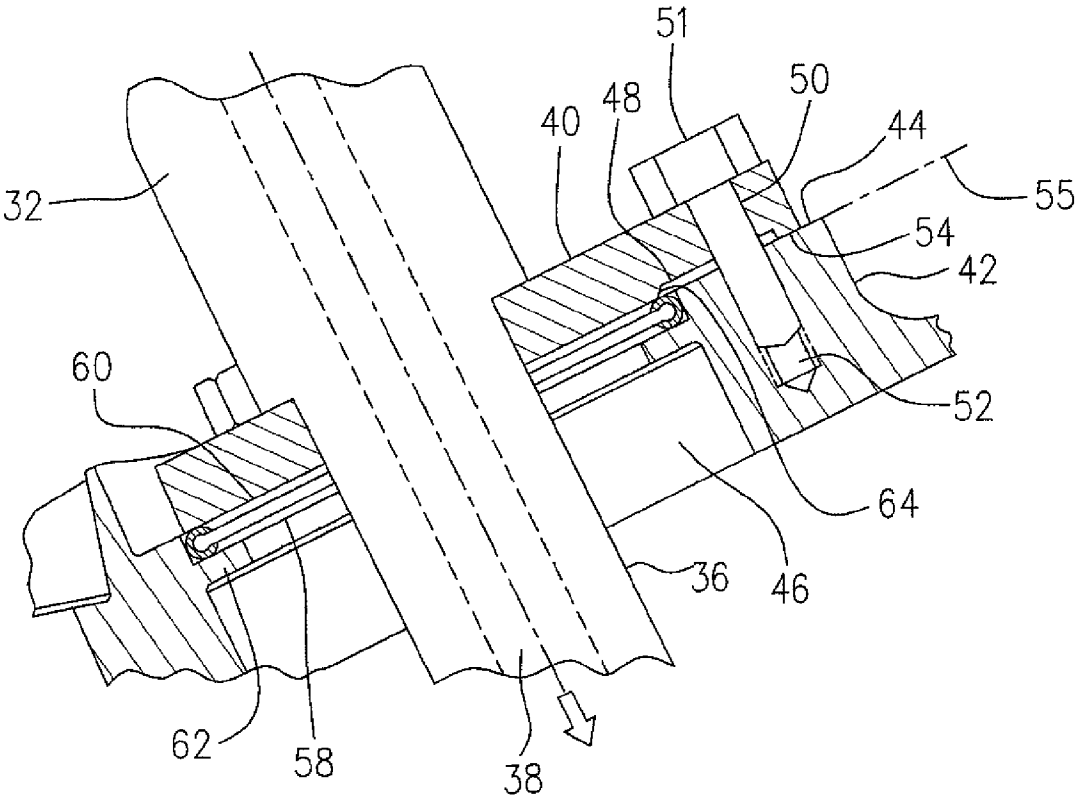
FIG. 3 is a cross-sectional partial view of a fuel nozzle installation structure according to one embodiment.
Figure 4:
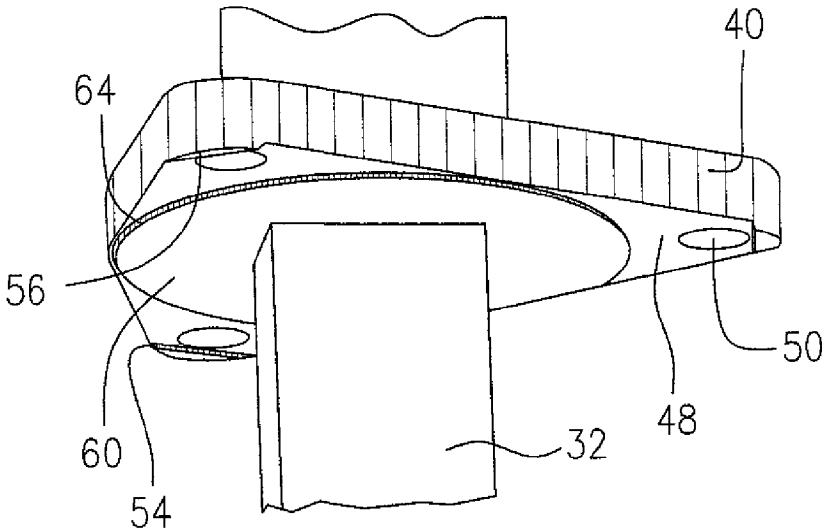
FIG. 4 is a perspective partial view of a fuel nozzle of the fuel nozzle installation structure of FIG. 3.

Referring now to FIGS. 3-4 (only one fuel nozzle is shown), the fuel nozzle 32 includes an elongate nozzle body 36 defining at least a fuel passage 38 in fluid communication with the fuel manifold 34 of FIG. 2. The inner configuration of the fuel nozzle 32 includes other features which are not part of the present invention and will not be further described herein. The fuel nozzle 32 further includes a flange 40 attached to the nozzle body 38, for example by welding. The flange 40 is disposed around the nozzle body 36 and extends radially and outwardly from the nozzle body 36.

A stationary support structure 42, for example a portion of a wall defining a combustion chamber of the combustor 26 of FIG. 1, has a flat mounting surface 44 and defines an aperture 46 in the mounting surface 44. The aperture 46 extends through the support structure 42 for receiving the nozzle body 36 of the fuel nozzle 32 to be inserted thereinto such that the flange 40 abuts the flat mounting surface 44 of the support structure 42.

Figure 8:
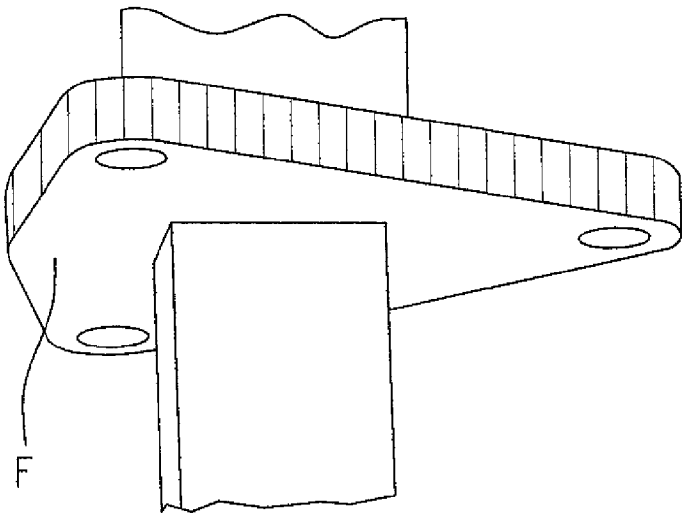
FIG. 8 PRIOR ART
FIG. 8 is perspective partial view of a prior art fuel nozzle.

In the prior art as shown in FIG. 8, the flange of a conventional fuel nozzle has a flat mounting face indicated by F which abuts the flat mounting surface 44 of the support structure 42 when the conventional fuel nozzle is installed in the support structure 42. The support structure 42 is disposed in the high temperature environment close to the combustion area, and therefore heat is transferred from the support structure 42 to the conventional fuel nozzle through the contact area of flat mounting surface 44 of the support structure 42 and the flat mounting face F of the conventional fuel nozzle of FIG. 8. The transferred heat causes rising temperature of the conventional fuel nozzle of FIG. 8.

Means for providing spacing between the flange and the mounting surface of the support structure 42 are provided in order to reduce heat transfer from the support structure 42 to the fuel nozzle 32 during engine operation, thereby controlling the temperature of the fuel nozzle 32.

Referring to FIGS. 3-4 again, the flange 40 of the fuel nozzle 32 according to one embodiment, defines a mounting face 48 thereof facing a downstream direction of the fuel flow which is indicated by an arrow in FIG. 3. The mounting face 48 includes a plurality of mounting holes 50 extending through the flange 40 and located substantially in accordance with the locations of corresponding mounting holes 52 which are defined in the flat mounting surface 44 and are distributed round the aperture 46 of the support structure 42. The flange 40 of the fuel nozzle 32 further includes a plurality of contacting lands 54 protruding from the mounting face 48 thereof. The contacting lands 54 preferably each define a small, flat contacting surface 56 which defines a contacting plane 55 substantially parallel to the flange 40 such that when the fuel nozzle 32 is installed in the support structure 42, the contacting lands 54 instead of the mounting face 48 of the flange 40, abut the flat mounting surface 44 of the support structure 42. Therefore, the contact area between the flange 40 of the fuel nozzle 32 and the mounting surface 44 of the support structure 42 is significantly reduced to the total surface area of the small flat contacting surface 56 of the contacting lands 54.

The number of contacting lands 54 is preferably equal to the number of mounting holes 50 in the flange 40 (in this embodiment three mounting holes and three contacting lands 54 are shown). The contacting lands 54 are preferably disposed adjacent to the respective mounting holes 50, such as in a location farther than the adjacent mounting holes 50 from the nozzle body 36, as shown in FIGS. 3 and 4, in order to provide a secure abutment of the flange 40 to the flat mounting surface 44 of the support structure 42 when mounting screws 51 are received in the respective aligned pairs of mounting holes 50, 52, and are tightly engaged with the support structure 42.

An annular seal indicated by numeral 58 is preferably disposed around the nozzle body 36 of the fuel nozzle 32 and is supported by the support structure 42. A seal surface 60 compressively abuts the annular seal 58 against the support structure 42 to prevent fluid communication between the environment and the aperture 46 leading to an inner cavity (not shown) defined within the support structure 42, in order to maintain a pressure differential therebetween.

In this embodiment, the aperture 46 of the support structure 42 includes an annular inner flange 62 forming an annular shoulder near the flat mounting surface 44 of the support structure 42 in order to support the annular seal 58. The annular seal 58 preferably has a C-shaped cross-section made of an appropriate metal material. The C-shaped cross-section of the annular seal 58 preferably has a height (or a width of the annular seal) slightly greater than a depth between the flat mounting surface 44 and a support surface of the inner flange 62. The seal surface 60 of the flange 40 is preferably defined by a central land 64 protruding from the mounting face 48 of the flange 40. The central land 64 is shaped and sized to substantially correspond with the aperture 46 (circular in this embodiment) in order to be fitted with the aperture 46. The central land 64 preferably has a height substantially equal to that of the contacting lands 54 such that the seal surface 60 is in the plane 55 defined by the small contacting surface 56 of the contacting lands 54. The central land 64 is thus separated from the contacting lands 54 and compressively abuts the annular seal 58. The seal surface 60 looks relatively large, however there is only an annular line of contact between the seal surface 60 and the annular seal 58. The contacting area for heat transfer between the flange 40 of the fuel nozzle 32 and the flat mounting surface 44 of the support structure 42 is still substantially restricted to a relatively small area in contrast to a fuel nozzle installation using a conventional fuel nozzle (see FIG. 8).

Figure 5:
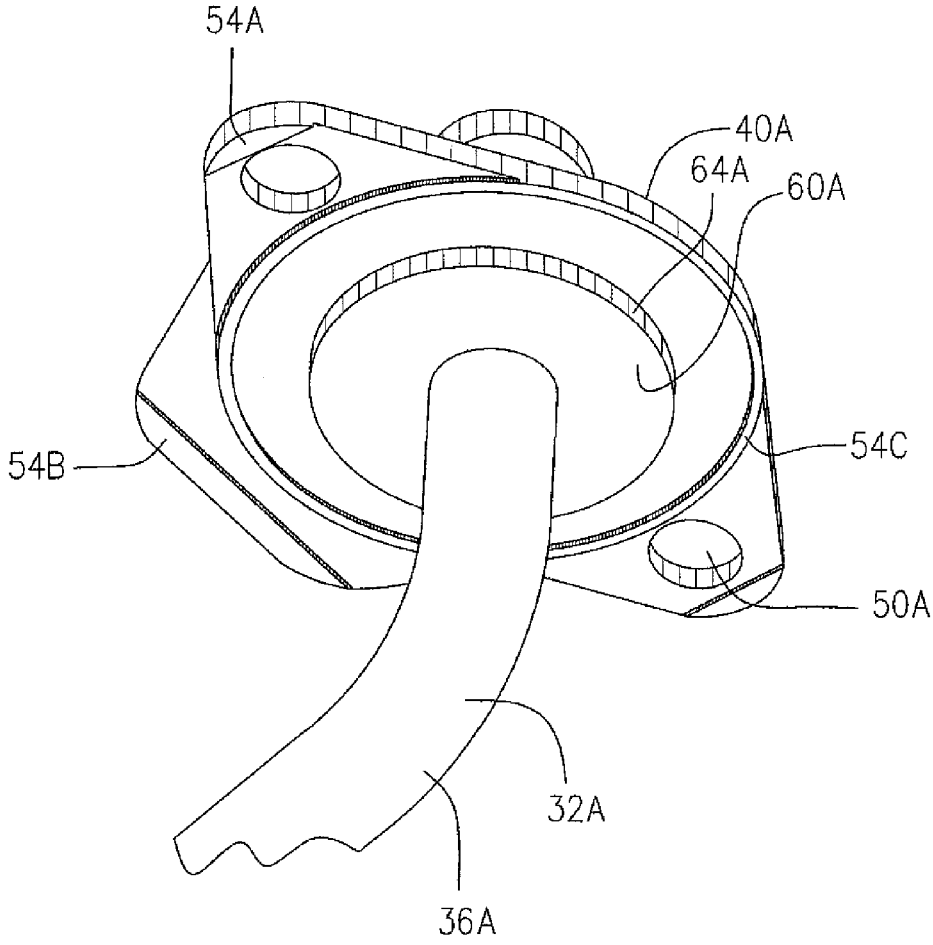
FIG. 5 is a perspective partial view of a fuel nozzle according to another embodiment.

The number and configuration of the contacting lands of the flange of the fuel nozzle may vary in order to be conveniently and effectively incorporated to various configurations of fuel nozzles. FIG. 5 illustrates another embodiment of the fuel nozzle installation structure according to another embodiment, in which a fuel nozzle has flange 40A extending radially and outwardly from the fuel nozzle body 36A, with two mounting holes 50A disposed in diametrically opposite locations. In addition to contacting lands 54A adjacent to the respective mounting holes 50A, similar to the three contacting lands 54 in FIG. 4, a third contacting land 54B is provided at one side of the diametrically opposite mounting holes 50A. Furthermore, an annular contacting land 54C is provided, coaxially with the nozzle body 36A, radially spaced from a central land 64A. The contacting lands in this embodiment are configured and distributed in order to reduce the heat transfer area between the flange 50A of the fuel nozzle 32A and a support structure (not shown) similar to the support structure 42 of FIG. 3, while providing a secure attachment of the fuel nozzle to the support structure. The seal surface 60A of the central land 64A is not in a plane defined by the contacting lands 54A, 54B and 54C. Other features of the fuel nozzle installation structure of this embodiment are similar to those of the embodiment described with reference to FIGS. 3 and 4 and will not be redundantly described.

Figure 6:
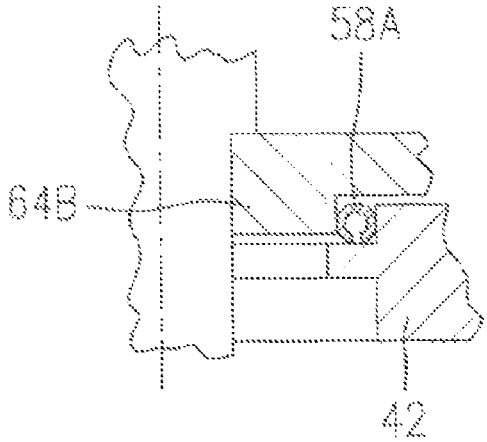
FIG. 6 is a cross-sectional partial view of a fuel nozzle installation structure according to a further embodiment.
Figure 7:
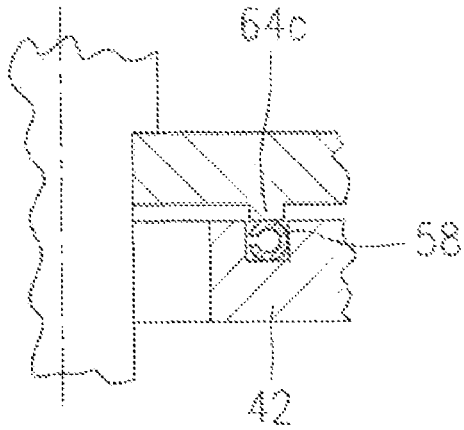
FIG. 7 is a cross-sectional partial view of a fuel nozzle installation structure according to still a further embodiment.
Figure 9:
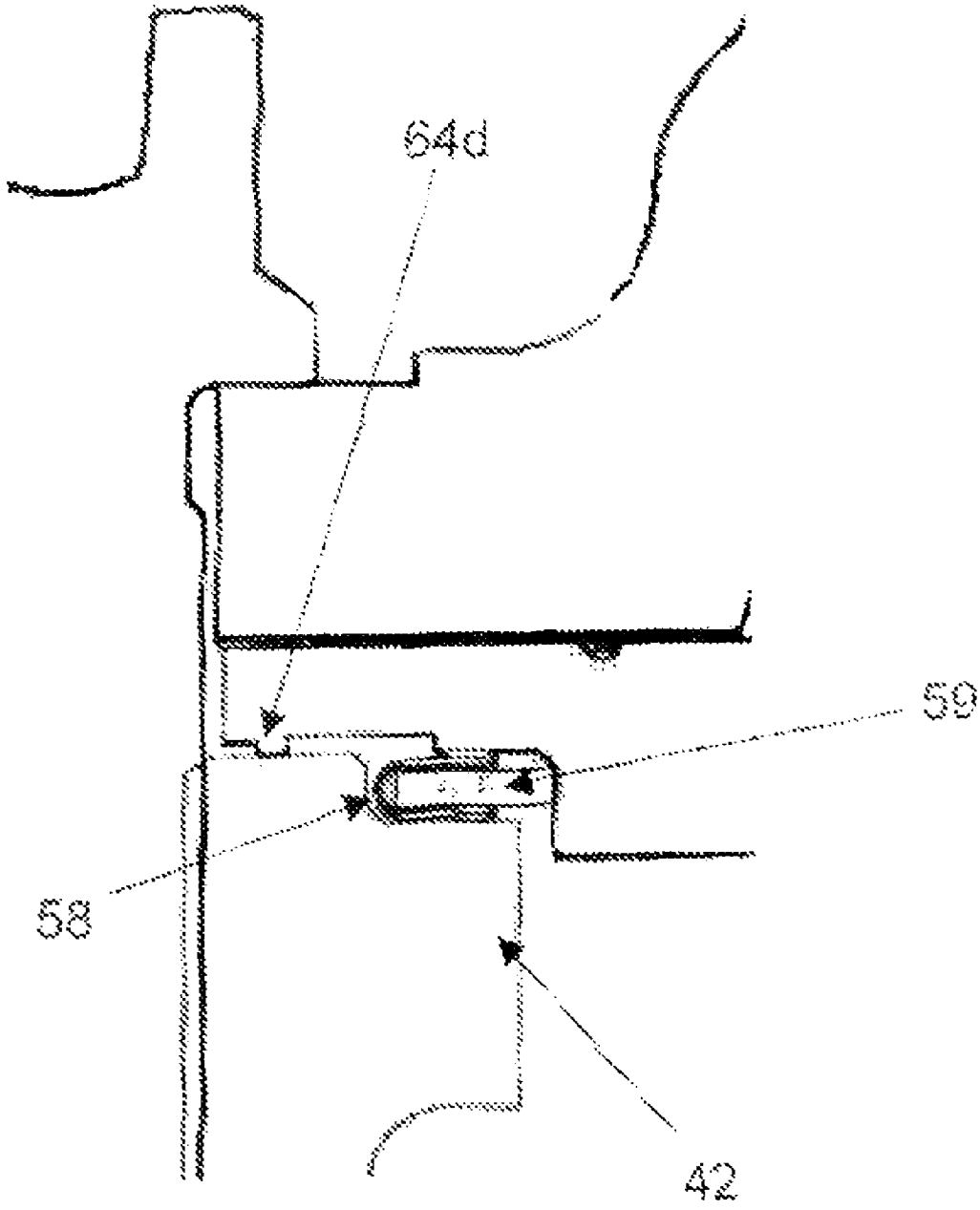
FIG. 9 is a cross-sectional partial view of a fuel nozzle installation structure according to yet another embodiment.

The above description is meant to be exemplary only, and one skilled in the art will recognize that changes may be made to the embodiments described without departure from the scope of the invention disclosed. For example, the annular seal ring may be disposed between the flange of the fuel nozzle and the support structure in a configuration alternative to the described embodiment. FIG. 6 illustrates an annular seal ring 58A supported in the support structure 42, similar to that of FIG. 3. However, a central land 64B is configured differently from the central land 64 of FIG. 4 such that the central land 64B compresses the annular seal ring 58A against the support structure 42 in a radial direction rather than the axial direction as shown in FIG. 3. In FIG. 7, the annular seal 58 is placed within an annular recess defined within the support structure 42, in contrast to being supported on the inner flange 62 as in FIG. 3, and the central land 64 of FIG. 3 is therefore defined as an annular ring 64C which is slightly narrower than the annular recess, to axially compress the annular seal 58 against the support structure 42. In FIG. 9, the annular seal 58 includes an inner, more rigid ring 59 to help maintain the seal in place during assembly, and the central land 64 of FIG. 3 is therefore defined as an annular ring 64*d* to support the fuel nozzle flange under load created by the bolt. The narrow band limits heat transfer into the nozzle while still leaving material on the nozzle flange to ensure that the load from the bolt does not excessively deform the fuel nozzle flange.

Still other modifications which fall within the scope of the present invention will be apparent to those skilled in the art, in light of a review of this disclosure, and such modifications are intended to fall within the appended claims.

The invention claimed is:

1. A fuel nozzle installation structure in a gas turbine engine, comprising:

a support structure including a flat mounting surface, and defining an aperture in the flat mounting surface, the aperture extending through the support structure and including an inner flange to form an annular shoulder;

a fuel nozzle including a nozzle body defining a passage therethrough for directing a fuel flow though the fuel nozzle and a flange around the nozzle body extending radially and outwardly from the nozzle body, the nozzle body being inserted into the aperture of the support structure and the flange of the fuel nozzle being mounted to the mounting surface of the support structure;

a spacing apparatus between the flange and the mounting surface to reduce heat transfer from the support structure to the fuel nozzle during engine operation, said spacing apparatus provided on the flange and extending from the flange to contact the mounting surface; and an annular seal disposed around the nozzle body and supported by the annular shoulder of the support structure, a seal surface of the flange of the fuel nozzle compressively abutting the annular seal against the support structure.

2. The fuel nozzle installation structure as defined in claim 1 wherein the means comprise a plurality of contacting lands protruding from a mounting face of the flange, facing a downstream direction of the fuel flow.

3. The fuel nozzle installation structure as defined in claim 2 defining a plurality of pairs of aligned mounting holes in the respective mounting surface of the support structure and the mounting face of the flange, at least one of the contacting lands being located adjacent to each pair of the aligned mounting holes.

4. The fuel nozzle installation structure as defined in claim 1 wherein the contacting lands of the flange each comprise a flat contacting surface, the contacting surfaces in combination with the seal surface defining an interface plane of the flange and the support structure.

5. The fuel nozzle installation structure as defined in claim 1 wherein the support structure comprises a portion of a wall defining a combustor chamber of the engine.

* * * * *